United States Patent [19]

Gentry et al.

[11] 4,400,109

[45] Aug. 23, 1983

[54] COMPLAINT RISER YOKE ASSEMBLY WITH BREAKWAY SUPPORT MEANS

[75] Inventors: Larry L. Gentry, Sunnyvale; Ronald I. Klootwyk, San Jose, both of Calif.

[73] Assignee: Mobil Oil Corporation, New York, N.Y.

[21] Appl. No.: 220,922

[22] Filed: Dec. 29, 1980

[51] Int. Cl.[3] ..... E21B 43/01; F16L 1/04

[52] U.S. Cl. ..... 405/195; 166/340; 166/350; 405/169

[58] Field of Search ..... 405/169, 195; 166/339, 166/340, 344, 345, 347, 350, 359, 366, 367

[56] References Cited

U.S. PATENT DOCUMENTS

| | | | |
|---|---|---|---|
| 3,589,441 | 6/1971 | Brown et al. | 166/339 X |
| 3,721,294 | 3/1973 | Nelson | 166/347 X |
| 4,182,584 | 1/1980 | Panicker et al. | 405/195 |
| 4,191,256 | 3/1980 | Croy et al. | 166/344 X |

*Primary Examiner*—David H. Corbin

*Attorney, Agent, or Firm*—C. A. Huggett; M. G. Gilman; J. F. Powers, Jr.

[57] ABSTRACT

A marine compliant riser system is provided for attaching a flexible flowline to a buoyed conduit riser section. The improved system includes a releasable yoke assembly for receiving flexible flowline with a means for holding flexible flowline termination.

Quick-disconnect yoke attachment means support and lock the yoke assembly onto horizontal buoy-mounted support means. A fail-safe release means is provided for pulling an unreleased yoke attachment away from the support arm in the event of an opposite end release.

The system is particularly adapted for emergency disconnect of a subsea wellhead or production gathering system from a floating vessel.

4 Claims, 11 Drawing Figures

COMPLAINT RISER YOKE ASSEMBLY WITH BREAKWAY SUPPORT MEANS

BACKGROUND OF THE INVENTION

This invention relates to a marine riser system. In particular, it relates to apparatus for connecting a surface facility releasably from an intermediate structure, which is in turn connected to a subsea wellhead or gathering system.

In the production of fluid hydrocarbons from deep-water marine oil and gas deposits, a fluid communication system from the marine bottom to the surface after production is required. Such a system, commonly called a production riser, usually includes multiple conduits through which various produced fluids are transported to and from the surface, including oil and gas production lines, service and hydraulic control lines and electrical imbilicals.

In many offshore production areas, a floating facility can be used as a production and/or storage platform. Since the facility is exposed to surface and sub-surface conditions, it undergoes a variety of movements. In such a zone of turbulence, heave, roll, pitch, drift, etc., may be caused by surface and near surface conditions. In order for a production riser system to function adequately with such a facility, it must be sufficiently compliant to compensate for such movements over long periods of operation without failure.

Such a marine riser is disclosed in U.S. Pat. No. 4,182,584. This compliant riser system includes (1) a rigid section which extends from the marine bottom to a fixed position just below the zone of turbulence that exists near the surface of the water, and (2) a flexible section which is comprised of flexible flowlines that extend from the top of the rigid section, through the turbulent zone, to a floating vessel on the surface. A submerged buoy is attached to the top of the rigid section to maintain the rigid section in a substantially vertical position within the water. With riser systems of this type difficulties often arise in installing and maintaining the flexible conduits. Often the flexible flowline is attached to a rigid section such that the end portion adjacent the fixed or rigid portion is not attached at a normal catenary departure angle. This can result in localized stresses, causing undue wear in the flexible flowline at its terminal hardware, If a natural catenary shape is assumed by the flowline, it approaches the fixed position section pointed upwardly, nearly vertical at its point of suspension.

It is an object of this invention to provide a compliant riser system in which the flexible section assumes a substantially vertical departure angle at its terminal portion, whereby the flexible section conduits are supported longitudinally with relatively low transverse force vectors. It is another object to provide a releasable yoke assembly for connecting a flexible flowline bundle to a submerged riser support. It is a further object of this invention to provide a technique for connecting an ocean floor facility, such as a subsea wellhead or the like, to a marine surface facility through a compliant riser having a fixed position lower riser section extending from the marine bottom toward the surface facility and terminating below turbulent water. This can be achieved with a releasably mounted yoke assembly which provides terminal support at one end of a catenary flowline during installation.

SUMMARY OF THE INVENTION

A compliant riser is provided for connecting a marine hydrocarbon production system between a marine bottom base through a fixed-position riser section and flexible flowline section to a surface facility. A novel connection mechanism permits a compliant flowline bundle to be released quickly from the fixed riser section. Slotted, lateral support arms mounted on the fixed riser section at a top portion receive a yoke beam beside the fixed riser section. A yoke assembly supports one end of a plurality of flexible conduits in catenary arrangement, including a yoke beam for retaining the conduit ends in spaced apart positions between the support arms. The yoke assembly and support arms are disposed to permit the yoke assembly to fall freely from the fixed riser section and support arms by releasing a single retractable pin. This may be achieved by providing releasable beam end support means for mounting the yoke beam adjacent the fixed riser section on corresponding lateral support arms. This releasable beam end support means comprises at least one laterally-projecting beam extension member extending outwardly from the beam end over a corresponding support arm and adapted for passing through a mating slot in the support arm. Fail-safe breakaway of the yoke assembly is assured by horizontally-retractable pin means disposed between each beam extension member and corresponding support arm, with the pin means including a span portion overlying the support arm slot and directly supporting the beam extension member, whereby the yoke beam bears indirectly on the support arms through said retractable pin means. Advantageously, the yoke release mechanism includes a remotely-activated power means for retracting the pin means and span portion away from the support arm slot. This retraction permits each beam extension member to fall through its support arm slot.

It is a significant feature of this invention that the release of a single retractable pin permits release of the entire yoke assembly, thus avoiding possible damage to the flowline bundle by suspending the yoke from a single, unreleased end support.

The apparatus and installation methods are particularly advantageous in providing multiple flowline compliant risers which are individually supported in a relatively unstressed position. These and other advantages and features will be seen in the following drawing and description of preferred embodiments.

THE DRAWING

DESCRIPTION OF THE PREFERRED EMBODIMENTS

In the following explanation of the invention concept, certain portions of the overall compliant riser system are shown by example merely to illustrate a typical operative embodiment. However, modifications and variations can be made within the scope of the invention. For instance, the surface facility need not be a production vessel, semi-submersible units or floating platforms being viable alternative structures for use with compliant risers, as shown in U.S. Pat. No. 4,098,333. Likewise, the specific structure of the marine bottom connection may be adapted for single wellheads, multi-well gathering and production systems and/or manifolds for receiving and handling oil and gas. Submerged, free-standing lower riser sections need not be rigid conduits, since buoy-tensioned flexible tubing or hoses can be maintained in fixed position when attached to the ocean floor, as shown in U.S. Pat. No. 3,911,688 and French Pat. No. 2,370,219 (Coflexip). Limited excursion of the lower riser section is permissible, but the catenary upper section is relied upon to permit significant horizontal excursion and elevational changes in the surface facility.

Figure 1:
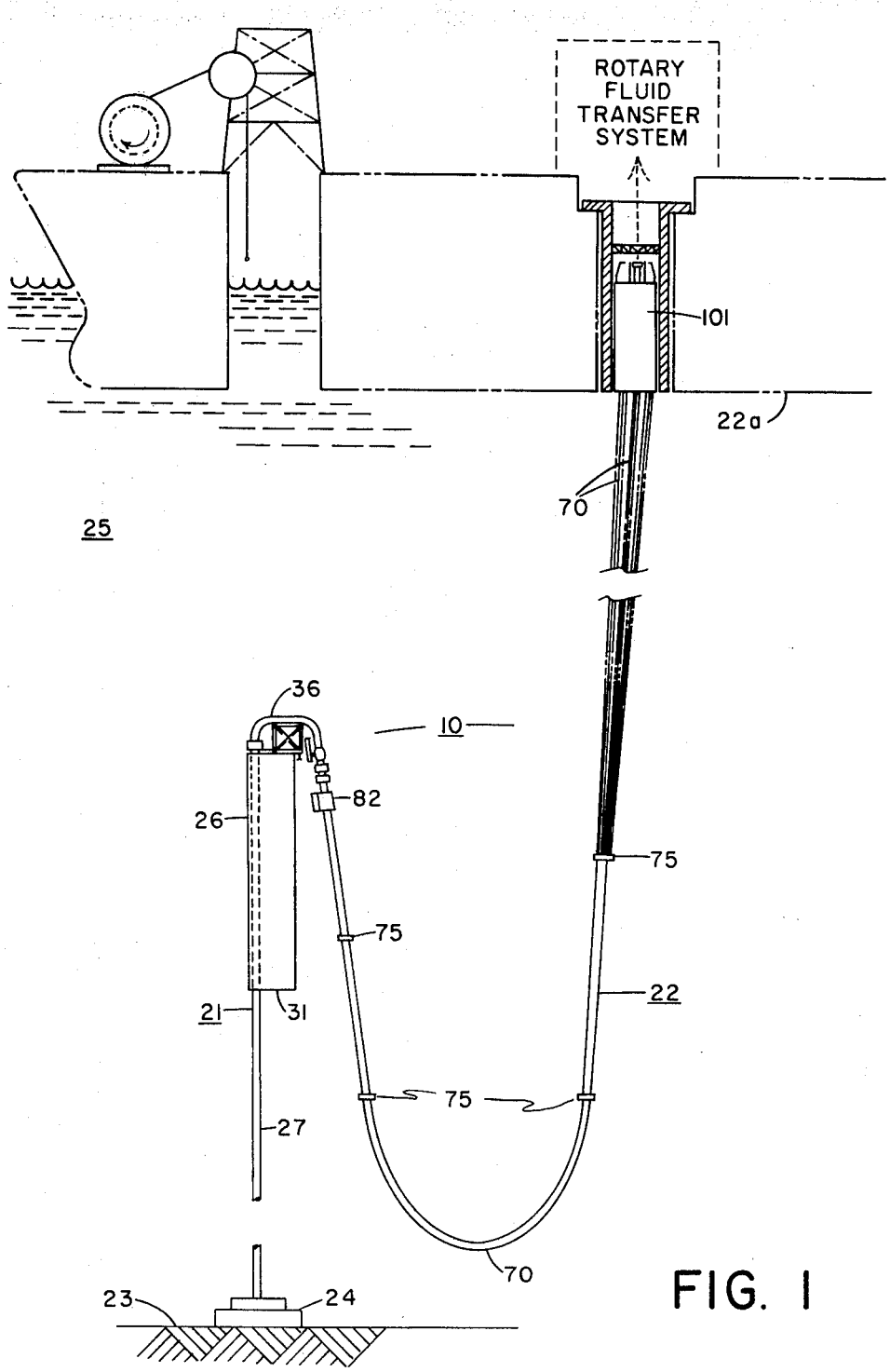
FIG. 1 is a schematic representation of a marine riser system, with a side view of a floating vessel and subsea components.

Referring now to the drawings, FIG. 1 discloses marine compliant riser system 10 in an operational position at an offshore location. The riser system has a lower rigid section 21 and an upper flexible section 22. Lower rigid section 21 is affixed to base 24 on marine bottom 23 and extends upwardly to a point just below turbulent zone 25, which is that zone of water below the surface which is normally affected by surface conditions, e.g. currents, surface winds, waves, etc. Buoy section 26 is positioned at the top of rigid section 21 to maintain rigid section 21 in a vertical position under tension. Flexible section 22 has a plurality of flexible conduits which are operatively connected to respective flow passages in rigid section 21 at buoy section 26. Flexible section 22 extends downwardly from buoy section 26 through a catenary path before extending upwardly to the surface, where it is connected to the floating facility 22*a*.

Lower Rigid Section

As shown in FIG. 1, base portion 24 is positioned on the marine bottom and submerged flowlines from individual wells may be completed thereto. Base 24 may be a wellhead, multi-well completion template, a submerged manifold center, or a like subsea structure. Each submerged flowline terminates on base 24 and preferably has a remote connector, e.g., "stab-in" connector, attached to lower end thereof. As illustrated in FIGS. 1 to 5, rigid section 21 may be constructed with a casing 27, which has a connector assembly (not shown) on its lower end which in turn is adapted to mate with mounting means on base 24 to secure casing 27 to base 24.

Figure 2:
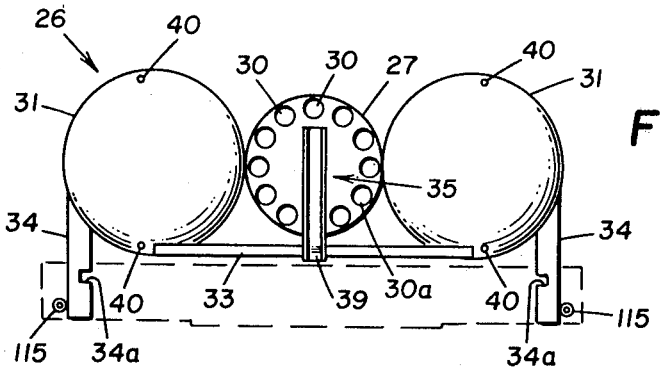
FIG. 2 is a plan view of the buoy portion, with a top connection portion removed.

As shown in FIG. 2, a plurality of individual rigid flowlines or conduits 30, which may be of the same or diverse diameters, are run through guides within or externally attached to casing 27 in a known manner. These are attached via stab-in or screw-in connectors of the submerged flowlines on base 24, providing individual flowpaths from marine bottom 23 to a point adjacent the buoy means at the top of casing 27.

Riser Buoy Section Subsystem

Figure 3:
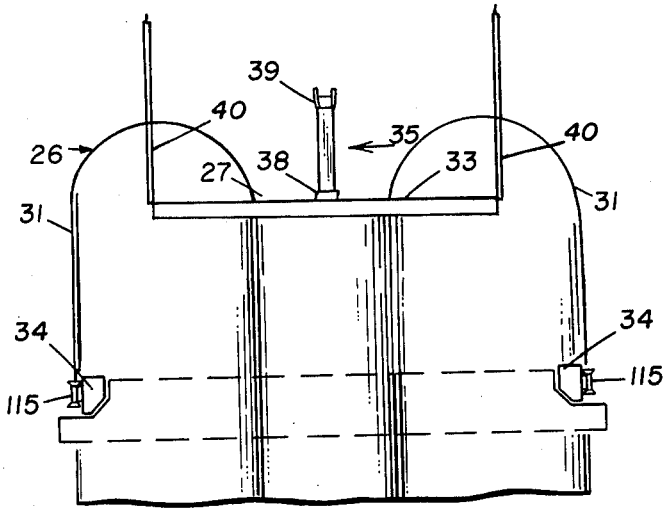
FIG. 3 is a side elevation view of the buoy portion, showing the relationship of the yoke beam in dashed line.

Located at the top of casing 27 is buoy section 26 which is comprised of multiple buoyant chambers 31, affixed diametrically opposite at either side of casing 27. As shown in FIGS. 2 and 3, beam 33 extends between chambers 31 near their upper ends and is attached thereto. Yoke-receiving lateral support arms 34 are attached to the outboard edges of chambers 31 and extend horizontally outward therefrom. Between the main buoy structure and the end of each support arm 34 is provided a slot 34*a* or knotched portion cut on the inside edge of the arm member. These slots are adapted to support a spanning dual-transmitting member of the yoke assembly as hereinafter described.

Figure 5:
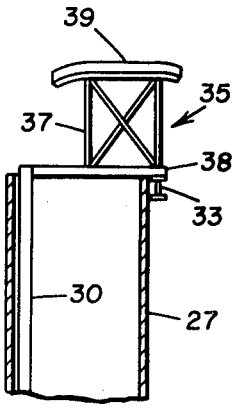
FIG. 5 is a vertical cross-section view of a typical buoy.
Figure 4:
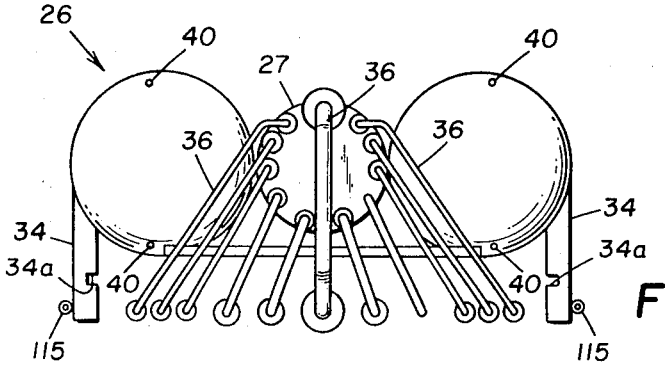
FIG. 4 is a plan view of the buoy section with a top connection assembly attached.

Mounted atop casing 27 and affixed to beam 33 on the buoy means are a plurality of support structures 35 for retaining inverted U-shaped connection assemblies. Although, for the sake of clarity, only one such support structure 35 is shown in FIGS. 2, 3, and 5 of the drawings, it should be understood that the overall support means includes a similar support structure 35 for each rigid conduit 30 within casing 27. Referring to FIG. 5, a typical support structure 35 is comprised of a vertical frame 37 having a lower mounting element 38 affixed to buoy beam 33 and having a trough 39 secured along its upper surface. Trough 39 is sufficiently large to receive a corresponding U-shaped or "gooseneck" conduit 36. Guide posts 40 are attached to buoyant chambers 31 and extend upward therefrom (as shown in FIGS. 2, 3 and 4) to facilitate installation of the connection assemblies.

Figure 7:
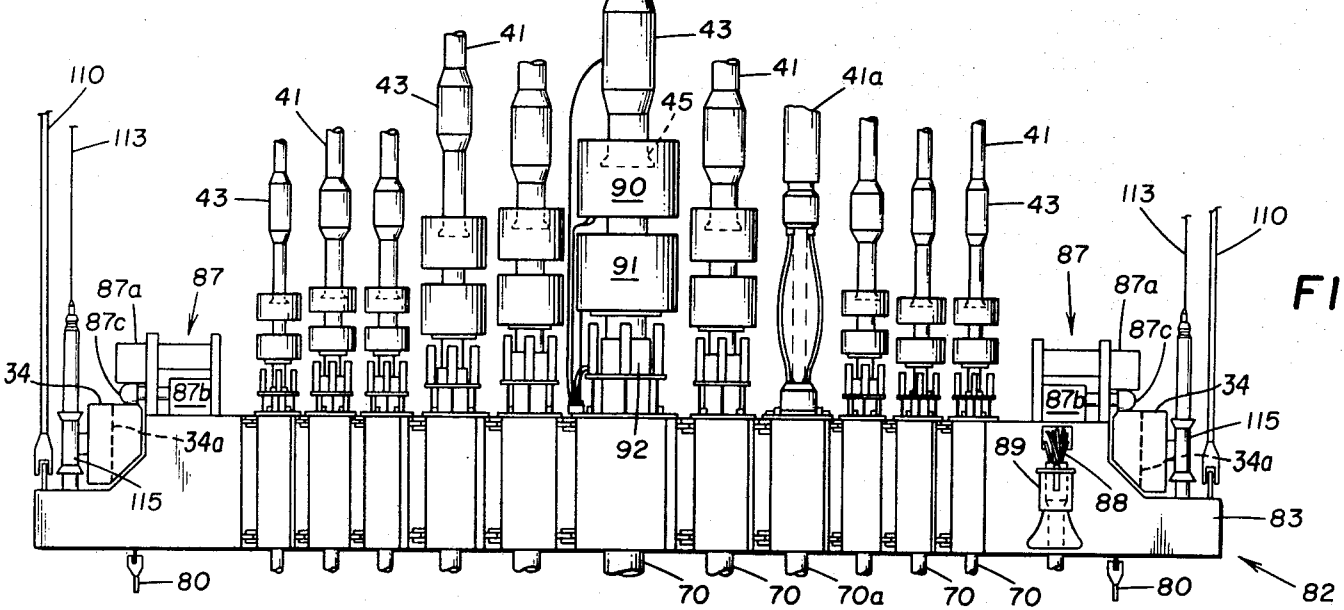
FIG. 7 is an elevation view of the novel yoke assembly, showing the connecting means for establishing fluid communication between the flexible section and connection assemblies.

A typical connection assembly including gooseneck conduit 36 is shown in FIGS. 1 and 7. Gooseneck conduit 36 is comprised of a length of a rigid conduit which is curved downward at both ends to provide an inverted U-shaped flow path. Connector means 42 (e.g. hydraulically-actuated collet connector) is attached to one end of conduit 41 and is adapted to couple conduit 41 fluidly to its respective rigid conduit 30 when gooseneck 36 is lowered into an operable position. The extreme environmental conditions of subsea handling systems may cause frequent equipment failures and repair problems. In order to minimize pollution and loss of product, fail-safe valves are usually employed for all flowlines. Redundant connectors and hydraulic operators are also desirable because of occasional equipment failures. Emergency shut-off valve means may be provided in conduit 41 just above its male end.

Flexible Flowline Section Subsystem

The compliant conduit section 22 (shown in FIG. 1) comprises a plurality of flexible catenary flowlines 70, each adapted to be operatively connected between the surface facility and its respective gooseneck conduit 36 on buoy section 26. The upper end of each flexible flow conduit 70 is attached at 71 to floating facility 22*a* by any suitable means. The preferred flexible flowlines are Coflexip multi-layered sheathed conduits. These are round conduits having a protective outer cover of low-friction material. The flowlines are commercially available in a variety of sizes and may be provided with releasable ends. The ribbon-type flowline bundle restrains the flexible conduits from substantial intercontact and provides sufficient clearance at the spreader beam guides 75 to permit unhindered longitudinal movement. Flexible conduits 70 are retained in parallel alignment or "ribbon" relationship substantially throughout their entire length. Multiple conduits of equal length can be held in this parallel relationship by a plurality of transverse spreader beams 75 longitudinally spaced along flexible conduits 70 (four shown in FIG. 1). In a preferred embodiment the surface end of the flowline bundle is connected to a rotary moonpool plug 101 on a surface vessel 22*a*, with the individual conduits 70 being arranged in a compact, non-linear array, and as a circle.

Yoke Assembly and Disconnect Subsystems

Figure 6:
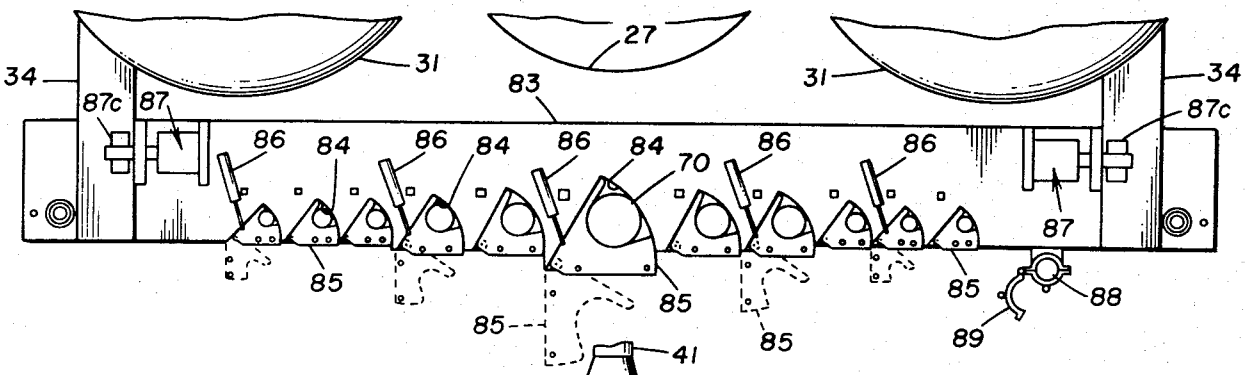
FIG. 6 is a detailed plan view of a yoke assembly for connecting the flexible section to the buoy section.

Yoke assembly 82 (FIGS. 6 and 7) provides means for mounting and connecting flexible conduit section 22 to buoy section 26. Yoke assembly 82 includes an elongated horizontal support member 83. This member may be a hollow steel box beam having a plurality of spaced-apart recesses 84 therein, which receive corresponding flexible flowlines 70 in linear array at horizontally spaced locations. Loading and locking means, such as gates 85 pivotally mounted at recesses 84, secure the terminations of flowlines 70 to the yoke. Hydraulic cylinders 86 actuate gates 85 laterally between an open position (dotted lines in FIG. 6) and a closed locking position. Hydraulic cylinders 86 may be permanently attached on yoke support beam 83 or releasably mounted to be installed by a diver when needed.

Hydraulically-actuated connecting pin assembies 87 are mounted at opposing ends of support element 83 and are adapted to support and lock the horizontal yoke support 83 to yoke arms 34 when yoke assembly 82 is in position at buoy section 26. The yoke assembly 82 is attached to the support arms 34 of the fixed riser section with releasable beam end support means 87 located at opposite ends of the yoke beam 83. This retractable attachment means has opposing retractable members 87*c* adapted to be retained adjacent arm slots 34*a* in spanning relationship. A D-shaped bar configuration and end mating arrangement between the yoke beam ends and support arms 34 permits the entire yoke assembly to fall away from the buoy section, thereby preventing angular distortion and damage to the flexible bundle in the event of attachment means failure or single retraction.

The yoke assembly may be attached initially to the fixed riser section support arms 34 by supporting the yoke, with or without the flowlines 70 attached, on cables 110. The yoke assembly is maneuvered under the support arms 34 along side the buoy section 26 and guided upwardly by guidelines 110 until the lower guide member is drawn into guide shoes 115, which prevent lateral movement of the yoke assembly relative to the support arms. The laterally-projecting beam extension member 87*a* passes through waiting slots 34*a*. Hydraulically operated reversible power means 87*b* pushes the retractable pin means 87*c* outwardly between the beam extension 87*c* and the support arms 34 to lock the yoke assembly onto the fixed riser section.

Hydraulic line 88 includes a number of individually pressurized conduits for actuating the various mechanisms on yoke assembly 82 and may be attached by means of manual gate 89.

A primary connector 90 (e.g. hydraulically-actuated collet connector) may be mounted on the end of each flexible conduit 70 and adapted to connect flexible conduit 70 remotely to male end 45 of a corresponding gooseneck conduit 41. To assure release of the flexible conduit from buoy section 26 in an emergency situation, an optional back-up or secondary redundant fluid connector 91 may be installed adjacent primary connector 90. Jackmeans 92 (FIG. 7) are then actuated to move individual flowline connectors 90 into engagement with respective male ends 45 of rigid conduits 36. Connector 90 is closed to secure the connection between conduit 36 and flexible conduit 70. Diver then makes up the electrical connection between cables 41*a* and 70*a* to complete the installation.

Figure 8:
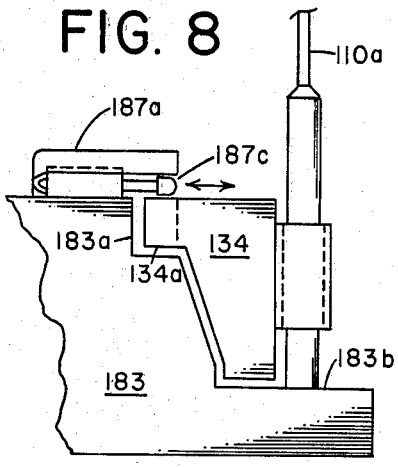
FIG. 8 is a detailed side view of an alternative yoke beam and support arm mating design.

In FIG. 8 an alternative beam end and support arm configuration is shown in elevational detail. Support arm 134 has a generally L-shaped cross-section, with the slotted portion 134A located in an upper lateral extension of the support, opening inwardly toward the waiting end of yoke beam 183. The beam extension member 187A extends from an upper surface of beam 183 over the support arm slot 134A, with retractable pin means 187*c* interposed in spanning relationship across the arm slot. Yoke beam 183 has a cutout portion 183A immediately adjacent the extension member 187 for receiving the corresponding slotted portion of support arm 134 therein. A lower integral beam portion 183B extends below the support arm at each end of the yoke beam. In addition to its function in assuring fail-safe break away during release of the yoke assembly, this configuration provides a point of attachment for installation and guidelines 110A, and hinged or removable guide posts, etc. In the event of an opposing beam end release and retraction failure of pin 187*c*, a pivotal motion pulls the retraction pin inwardly, away from the support arm. Thus, the spanning member between beam extension 187A and the support arm slot 134A is drawn over the upper inside edge of the support arm, releasing the otherwise inoperative beam support.

Figure 9:
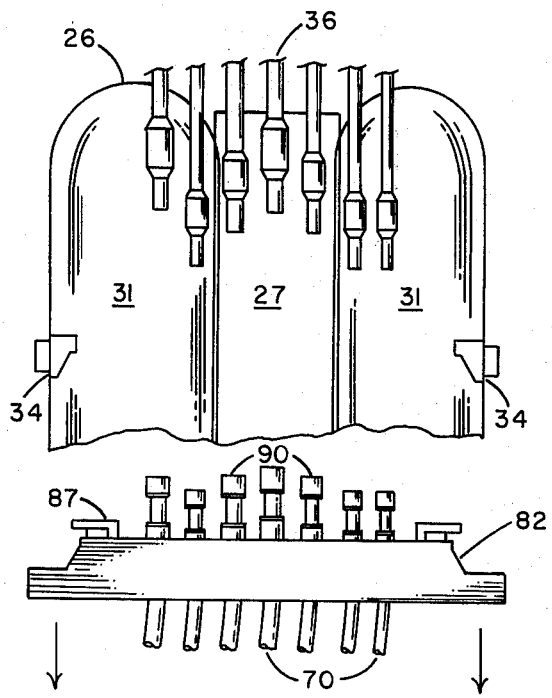
FIG. 9 is a side view of a buoy riser section and flowline yoke assembly during release thereof.
Figure 10:
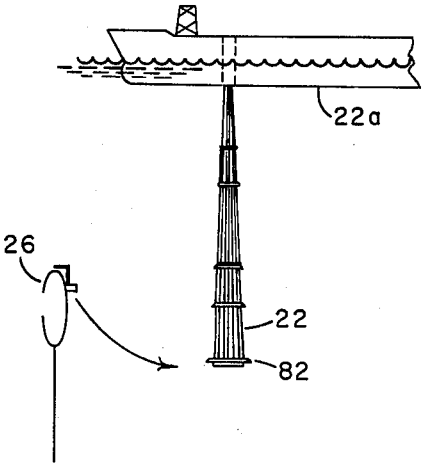
FIG. 10 is a schematic representation of the flexible flowline bundle and yoke assembly after release from the fixed riser.
Figure 11:
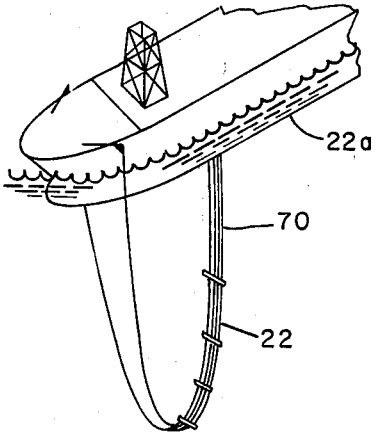
FIG. 11 is a schematic representation of a handling technique for controlling the released flexible flowline bundle from the surface facility.

FIGS. 9 to 11 illustrate the normal disconnection sequence for removing the flexible flow line from the fixed riser section. First the rigid correction assemblies 36 are released by remotely actuating hydraulic correctors 90 through the individual hydraulic control lines 88. The flexible conduits then drop out the yoke assembly 82 and have their weight supported across arms 34 through releasable beam support means 87. Ordinarily the two opposite retraction pins are actuated simultaneously and the yoke assembly falls away from the buoyed riser section 26, as shown in FIG. 9.

After clearing the fixed riser section, the flexible flowline bundle is supported only by one end at surface facility 22*a*, as shown in FIG. 10. In order to prevent tangling of the flowline conduits or contact with subsea objects, the yoke end of the flexible flowline 22 may be attached to tether lines and pulled upwardly toward the floating surface vessel 22*a*, as shown in FIG. 11. The above-described yoke assembly provides means for rapid, remote disconnection of all flowlines, service lines, hydraulic control lines, etc. at once in case of operational emergency. In the event of severe storm weather, collisions, fires or other emergency conditions, a quick disconnect system allows remote control by electro-hydraulic control means.

The design of the yoke support retraction pins spanning the support arm slots renders this portion of the yoke assembly relatively insensitive to dynamic influences, which might inadvertently release with a different load-bearing design. By placing the retractable spanning pin members between the yoke beam extension and support arm in a load-transmitting position, vibrational movement of the moveable members and accidental release are avoided.

What is claimed is:

1. In a compliant riser for connecting a marine hydrocarbon production system between a marine bottom base through a fixed-position riser section and flexible flowline section to a surface facility, the improvement which comprises:

slotted, lateral support arms mounted on the fixed riser section at a top portion thereof for receiving a yoke beam beside the fixed riser section;

yoke assembly means including said yoke beam for supporting one end of a plurality of flexible conduits in catenary arrangement and retaining said conduit ends in spaced apart positions between said lateral support arms;

releasable beam end support means at each end of said yoke beam for mounting said yoke beam adjacent the fixed riser section on a corresponding one of said lateral support arms; each of said releasable beam end support means comprising at least one laterally-projecting beam extension member extending outwardly from the beam end over a corresponding one of said lateral support arms and adapted for passing through a mating slot in said lateral support arm, and horizontally-retractable pin means disposed between each of said beam extension members and its corresponding lateral support arm, each of said pin means including a span portion overlying the corresponding support arm slot and directly supporting the corresponding beam extension member, whereby said yoke beam bears indirectly on said lateral support arms through each of said pin means;

power means for retracting each of said pin means and corresponding span portion away from the corresponding support arm slot; and said yoke assembly means and said lateral support arms being disposed to permit said yoke assembly means to fall freely from the fixed riser section and said support arms by retracting at least one of said pin means.

2. The compliant riser of claim 1 wherein said yoke beam extends between said lateral support arms and has a cut out portion at each end thereof immediately adjacent a respective one of said beam extension members for receiving corresponding slotted portions of said lateral support arms; said yoke beam having a lower integral beam portion extending below each of the respective lateral support arms at each end of said yoke beam.

3. The compliant riser of claim 1 wherein one of said pin means pivots inwardly away from its lateral support arm in the event the other of said pin means is released.

4. A marine compliant riser system for connecting a subsea hydrocarbon source to a floating surface facility through a lower multi-conduit riser section to a submerged buoy section located below a turbulent water zone and a flexible flowline comprising:

a plurality of flexible conduits for fluid connection between corresponding lower riser conduits and the surface facility;

releasable connection assembly means for connecting upwardly-directed flexible conduits with corresponding upwardly-directed lower riser conduits in fluid flow relationship;

a plurality of laterally-spaced support members attached to the submerged buoy section;

a yoke assembly mounted on the support members, including beam means for holding a plurality of spaced apart flexible conduit terminations; and quick-disconnect yoke attachment means at each end of the yoke assembly for supporting and locking the yoke assembly onto the support members including fail-safe pin release means for pivoting one of said yoke attachment means away from its respective support member in the event the other of said yoke attachment means is released.

* * * * *